US012188315B2

(12) United States Patent
Gupta et al.

(10) Patent No.: US 12,188,315 B2
(45) Date of Patent: Jan. 7, 2025

(54) EXPANDABLE PACKER ASSEMBLY AND SETTING ASSEMBLY

(71) Applicant: Schlumberger Technology Corporation, Sugar Land, TX (US)

(72) Inventors: Susheel Kumar Gupta, Rosharon, TX (US); Oscar Rodriguez, Rosharon, TX (US); Farshad Odakkal, Pune (IN)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/702,136

(22) PCT Filed: Dec. 5, 2022

(86) PCT No.: PCT/US2022/051828
§ 371 (c)(1),
(2) Date: Apr. 17, 2024

(87) PCT Pub. No.: WO2023/107377
PCT Pub. Date: Jun. 15, 2023

(65) Prior Publication Data

US 2024/0328269 A1 Oct. 3, 2024

(30) Foreign Application Priority Data

Dec. 8, 2021 (IN) ..... 202121057067

(51) Int. Cl.
*E21B 23/06* (2006.01)
*E21B 33/128* (2006.01)

(52) U.S. Cl.
CPC ..... *E21B 23/06* (2013.01); *E21B 33/128* (2013.01)

(58) Field of Classification Search
CPC .... E21B 23/06; E21B 33/128; E21B 33/1285; E21B 33/1295; E21B 23/01
See application file for complete search history.

(56) References Cited

U.S. PATENT DOCUMENTS 4,516,634 A 5/1985 Pitts
5,217,077 A 6/1993 Hart
(Continued)

FOREIGN PATENT DOCUMENTS

EP 0496540 A1 7/1992
WO 2012119249 A1 9/2012
WO WO-2024010837 A1 * 1/2024

OTHER PUBLICATIONS

International Search Report and Written Opinion issued on Apr. 19, 2023 in PCT Appl. No. PCT/US2022/051828.

*Primary Examiner* — Daniel P Stephenson
(74) *Attorney, Agent, or Firm* — Jeffrey D. Frantz

(57) ABSTRACT

A packer system includes a packer assembly and a setting assembly. The packer assembly includes a packer mandrel that includes a shifting profile and an activation profile formed on an inner surface of the packer mandrel and an expandable packer. The setting assembly is positionable within a bore of the packer mandrel and includes a setting mandrel, an activation collet positioned about the setting mandrel and engageable with the activation profile to shear a first shear device and enable the setting assembly to move from a run-in position to an intermediate position, and a setting collet positioned about the setting mandrel and engageable with the shifting profile to shear a second shear device and enable the setting assembly to move from the intermediate position to a setting position where fluid within a bore of the setting mandrel can flow through the setting port to expand the expandable packer.

20 Claims, 7 Drawing Sheets

(56) References Cited

U.S. PATENT DOCUMENTS

| | | | | |
|---|---|---|---|---|
| 5,375,662 | A | 12/1994 | Echols, III et al. | |
| 6,481,496 | B1 * | 11/2002 | Jackson | E21B 33/128 166/123 |
| 2016/0168938 | A1 * | 6/2016 | Pray | E21B 23/06 166/377 |
| 2018/0106127 | A1 * | 4/2018 | Du | E21B 33/1285 |
| 2024/0011366 | A1 * | 1/2024 | Alders | E21B 43/14 |

* cited by examiner

EXPANDABLE PACKER ASSEMBLY AND SETTING ASSEMBLY

CROSS-REFERENCE TO RELATED APPLICATIONS

This application is the National Stage Entry of International Application No. PCT/US2022/051828, filed Dec. 5, 2022, which claims the benefit of Indian patent application Ser. No. 202121057067, entitled "An Apparatus and Method to Set Packer, Bridge Plug, or Frac Plug Primarily Used in Sandface Gravel Packer Operation Using External Hydraulic Pressure," filed Dec. 8, 2021, the disclosure of which is incorporated herein by reference in its entirety.

BACKGROUND

Hydrocarbons produced from a subterranean formation oftentimes have sand or other particulates disposed therein. As the sand is undesirable to produce, many techniques exist for reducing the sand content in the hydrocarbons. Gravel packing is one technique used to filter and separate the sand from the hydrocarbons in a wellbore. Gravel packing generally involves pumping a gravel slurry, including gravel dispersed within a carrier fluid, down a work string and into the annulus formed between a completion assembly and the wall of the wellbore. The gravel is used to filter and separate the sand from the hydrocarbons as the hydrocarbons flow from the formation, into a completion assembly, and up to the surface.

One or more packers are oftentimes set or actuated prior to gravel packing. Upon actuation, the packers expand radially outward into contact with the wall of the wellbore to isolate different layers or zones of the formation. Isolating the different zones prevents the cross-flow of fluids (e.g., hydrocarbon fluids such as oil or gas) between the different zones and reduces the amount of water produced from the formation. One type of packer that is commonly used is a swellable packer that actuates when placed in contact with a catalyst. Swellable packers, however, may take days or weeks to fully actuate and isolate the different zones. Another type of packer is actuated by dropping a ball into the work string until the ball comes to rest on a ball seat proximate the packer. The hydraulic pressure of the fluid within the work string is then increased from the surface to actuate the packer. The increased pressure places the work string and components coupled thereto under strain, which may eventually lead to failure.

SUMMARY

A packer system for use within a wellbore according to one or more embodiments of the present disclosure includes a first packer assembly and a setting assembly. The first packer assembly includes a packer mandrel and an expandable packer. The packer mandrel includes a shifting profile formed on an inner surface of the packer mandrel, an activation profile formed on the inner surface of the packer mandrel, and a packer setting port extending radially through the packer mandrel. The setting assembly is positionable at least partially within a bore of the packer mandrel and includes a setting mandrel, an activation collet, and a setting collet. The activation collet is positioned about the setting mandrel and engageable with the activation profile to shear a first shear device and enable the setting assembly to move from a run-in position to an intermediate position. The setting collet is positioned about the setting mandrel and engageable with the shifting profile to shear a second shear device and enable the setting assembly to move from the intermediate position to a setting position where fluid within a bore of the setting mandrel can flow through the setting port to expand the expandable packer.

A completion system according to one or more embodiments of the present disclosure includes a first packer assembly positionable within a wellbore, a tool string positionable within the wellbore, and a setting assembly coupled to the tool string and positionable at least partially within a bore of the packer mandrel. The first packer assembly includes a packer mandrel and an expandable packer. The packer mandrel includes a shifting profile formed on an inner surface of the packer mandrel, an activation profile formed on the inner surface of the packer mandrel, and a packer setting port extending radially through the packer mandrel. The setting assembly includes a setting mandrel, an activation collet, and a setting collet. The activation collet is positioned about the setting mandrel and engageable with the activation profile to shear a first shear device and enable the setting assembly to move from a run-in position to an intermediate position. The setting collet is positioned about the setting mandrel and engageable with the shifting profile to shear a second shear device and enable the setting assembly to move from the intermediate position to a setting position where fluid within a bore of the setting mandrel can flow through the setting port to expand the expandable packer.

A method of completing a wellbore according to one or more embodiments of the present disclosure includes positioning a first packer assembly within a wellbore. The method also includes running a tool string comprising a setting assembly in a run-in position into the wellbore such that the setting assembly is positioned at least partially within a bore of a packer mandrel of the first packer assembly. The method further includes shifting an activation collet to shear a first shear device and shift the setting assembly from the run-in position to an intermediate position. The method also includes shifting a setting collet to shift the setting assembly to shift the setting assembly from the intermediate position to a setting position. The method further includes flowing fluid within a bore of a setting mandrel of the setting assembly through a setting port of the setting assembly to expand an expandable packer of the first packer assembly.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various described technologies. The drawings are as follows.

DETAILED DESCRIPTION

In the following description, numerous details are set forth to provide an understanding of some embodiments of the present disclosure. However, it will be understood by those of ordinary skill in the art that embodiments of the present disclosure may be practiced without these details and that numerous variations or modifications from the described embodiments may be possible.

In the specification and appended claims: the terms "connect," "connection," "connected," "in connection with," "connecting," "couple," "coupled," "coupled with," and "coupling" are used to mean "in direct connection with" or "in connection with via another element." As used herein, the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

Figure 1:
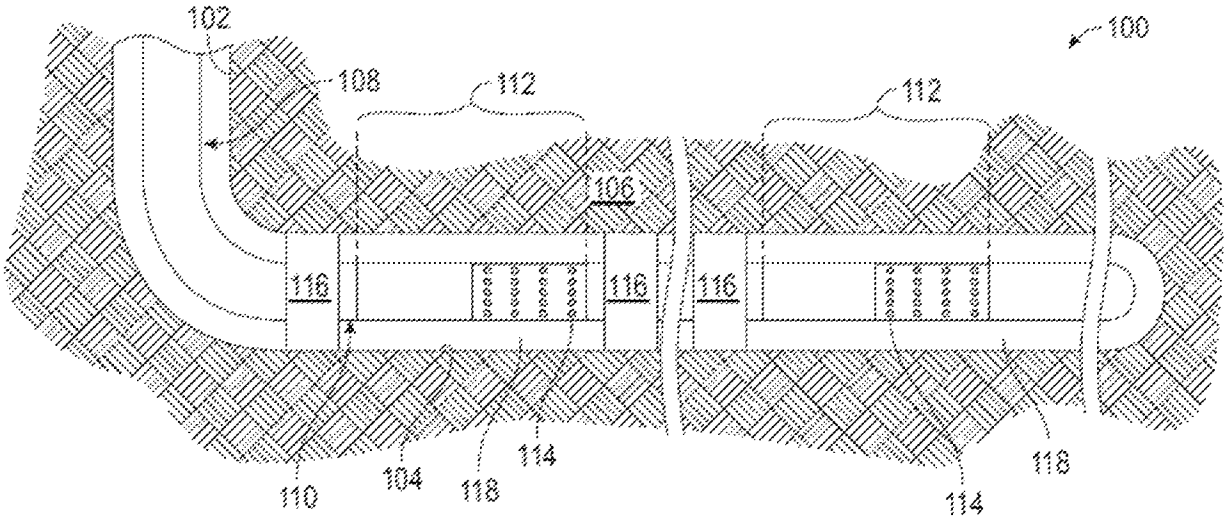
FIG. 1 is a schematic view of a well system according to one or more embodiments of the present disclosure.

Referring now to FIG. 1, FIG. 1 is a well system 100 that includes a wellbore 102 having a deviated wellbore section 104 extending into a formation 106 containing hydrocarbon fluids. Depending on the application, the wellbore 102 may comprise one or more deviated wellbore sections 104, e.g. horizontal wellbore sections, which may be cased or uncased. In the example illustrated, a tubing string 108 is deployed downhole into wellbore 102 and comprises a downhole well completion system 110 deployed in the deviated, e.g. horizontal, wellbore section 104.

The downhole well completion 110 system may be constructed to facilitate production of well fluids and/or injection of fluids. By way of example, the downhole well completion 110 system may comprise at least one sand screen joint 112, e.g. a plurality of screen assemblies 112. Each sand screen joint 112 may include a shroud, e.g. a sand screen, 114 that cover a screen filter through which fluid may enter the corresponding sand screen joint 112 for production to a suitable location, e.g. a surface location. For example, hydrocarbon well fluids may flow from formation 106, into wellbore 102, and into the screen assemblies 112 via the shrouds 114. In some embodiments, the downhole well completion system 110 also may comprise a plurality of packers 116 which may be used to isolate sections or zones 118 along the wellbore 102.

Figures 2, 3:
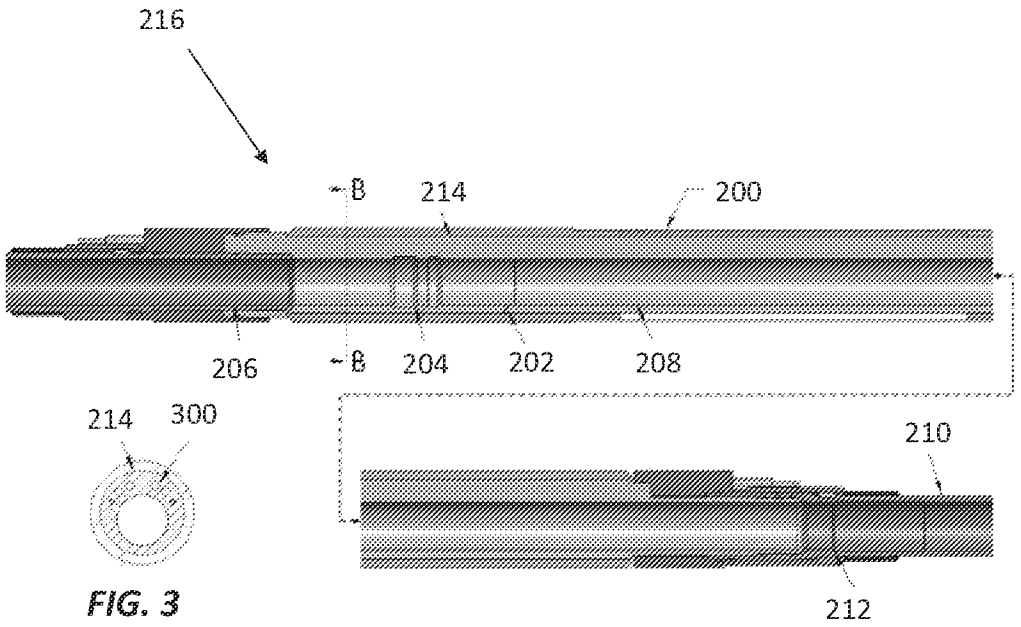
FIG. 2 is a packer assembly with an expandable packer according to one or more embodiments of the present disclosure.
FIG. 3 is a cross-section of the packer assembly 216 of FIG. 2 taken along line B-B.

Turning now to FIG. 2, FIG. 2 is a packer assembly 216 with an expandable packer 200, which, upon application of hydraulic pressure, inflates and seals the annulus between tubing and the wellbore. In one or more embodiments, the packer is a metallic packer. In other embodiments, the packer may be made of an elastomer, composite, or other type of material. The packer assembly 216 has a packer setting port 202 through which the hydraulic pressure is applied to the expandable steel sleeve system 200. The packer assembly 216 also may include a shifting profile 204 formed on the inner surface of the upper packer mandrel 214, as shown in FIG. 2, or formed in a sleeve positioned within the packer assembly 216. A setting system, as described in more detail below, engages with the profile 204 and hydraulic pressure can be applied through the setting system to set the packer from the surface.

In one or more embodiments, the packer includes polished bores 206, 208 uphole and downhole of the packer setting port 202 of the packer assembly 216. The packer assembly 216 may also include a lower packer mandrel 210 that has an activation profile 212 used during activation of the setting system, as described in more detail below, and an upper packer mandrel 214. In one or more embodiments, a single packer mandrel may be used in place of the upper packer mandrel 214 and the lower packer mandrel 210. The upper packer mandrel 214 includes bypass flow paths 300, as shown in FIG. 3, which is a cross-section of the packer assembly 216 of FIG. 2 taken along line B-B, to transfer fluid from upper annular region of the packer to the bottom annular region bypassing packer seal. In one or more embodiments, the flow paths 300 have end connections to connect to gravel shunt tubes of screen assemblies to support multizone gravel packing, as well as providing the capability to set the packer before gravel packing.

Figure 4:
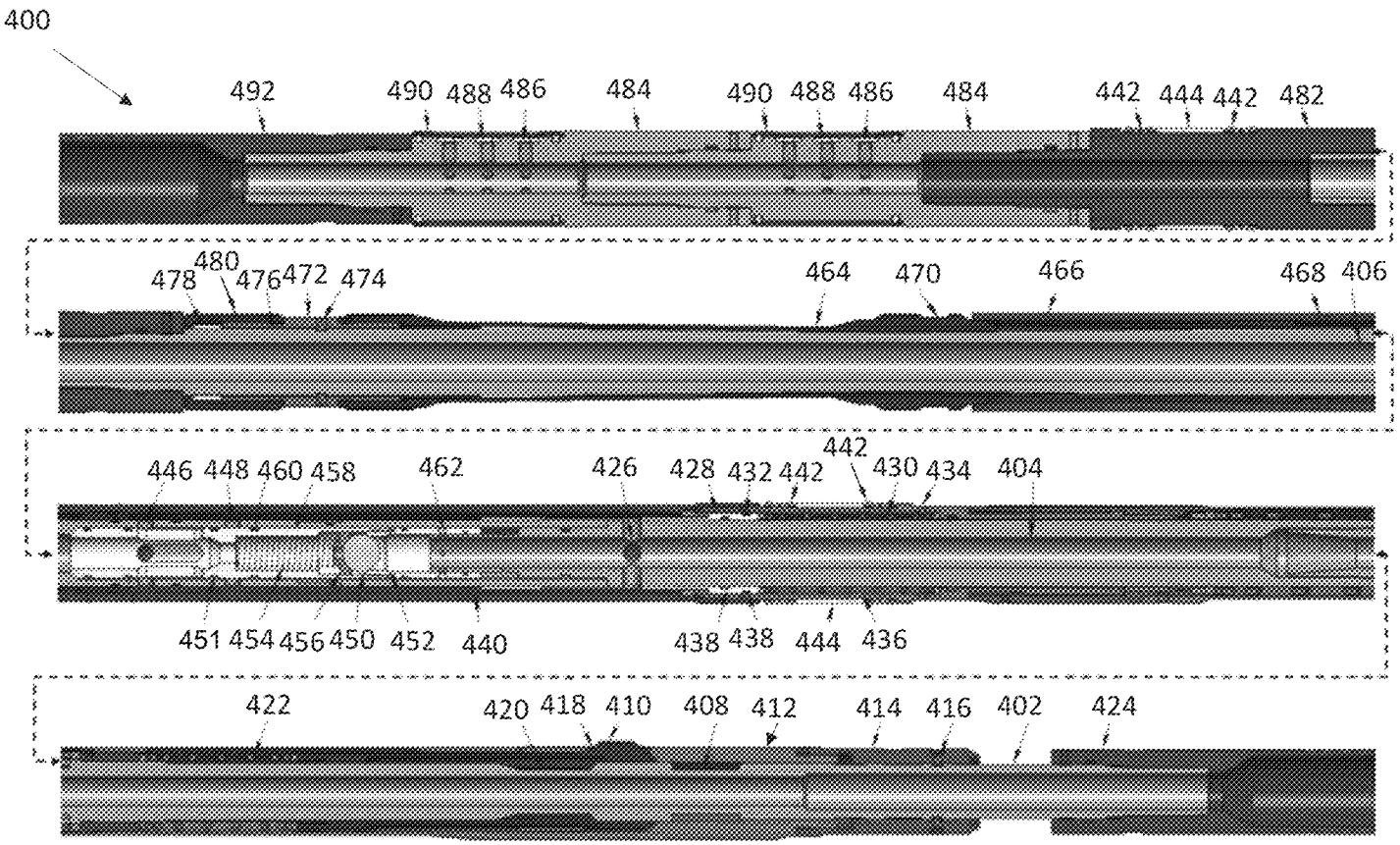
FIG. 4 is a setting assembly for setting expandable packer assemblies.

Turning now to FIG. 4, FIG. 4 is a setting assembly 400 for inflating or setting expandable steel sleeve packers, such as the packer assembly 216 described above, via external hydraulic pressure. The setting assembly 400 comprises of various modules to enable the setting assembly to run the packer in the deactivated condition and actuate when at setting depth such that pressure is applied from the surface to set the packer. The setting assembly 400 includes lower, middle, and upper setting mandrels 402, 404, 406. In other embodiments, the lower, middle, and upper setting mandrels 402, 404, 406 may be combined into a single mandrel or two mandrels. The lower mandrel 402 includes an outer recess 408 proximate an activation collet 410 that is positioned within an activation collet housing 412. The activation collet housing 412 is coupled to a lower shear sub 414, which is coupled to the lower mandrel 402 via a shear device 416 (e.g., shear screws). In the run-in configuration, the activation collet 410 is radially extended through activation collet housing 412. The activation collet 410 has an external activation profile 418 that retracts into a recess 420 in the lower mandrel via an activation collet spring 422 whenever the activation collet 410 contacts a restriction while running in hole. In one or more embodiments, a lower cross over 424 may be coupled to the lower mandrel 402 to enable connections with other tools on the tool string.

In one or more embodiments, the middle mandrel 404 has a washdown port 426 that enables the cleaning of wellbore through the setting assembly. Additionally, the washdown port may include a pressure shut-off mechanism to close the port 426 in case of a pressure surge. The pressure shut off mechanism includes of the pressure shut off sleeve 428 that is installed over the middle mandrel 404 and connected to a spring 430 inside a spring housing 432. The spring housing 432 includes a port 434 that allows a spring chamber 436 formed by the spring housing 432 and the middle mandrel 404 to fill with wellbore fluid at a hydrostatic pressure. Seals 438 are used on the shut off sleeve 428 to isolate the spring chamber 436 from a flow chamber 440. The spring housing 432 further includes a seal assembly to prevent setting pressure leaking to the well formation. The seal assembly may include two seals 442 that are spaced out via a spacer 444. In other embodiments, one, three, or more seals may be used in place of the seals 442 shown in FIG. 4.

In one or more embodiments, the upper mandrel 406 includes a pressure port 446, a deactivation port 448, and a standing valve mechanism 451. The standing valve mechanism 451 comprises a ball 450 which sits on the ball seat 452 and is retained against the ball seat 452 by a retaining system that includes spring 454 and a retainer 456. A spring cage 458 surrounding the spring includes a seal 460 that seals against the inner surface of the upper mandrel 406. The ball seat 452 is positioned within the spring cage 458, which is coupled to the middle mandrel 404 via a shear device 462 (e.g., shear screws). The deactivation port 448 is isolated from the spring cage 458 via the spring cage seal 460. The upper mandrel 406 also includes a second activation mechanism coupled to the outer surface. In one or more embodiments, the second activation mechanism includes a setting collet 464 that, when in the run-in configuration, is collapsed within a flow housing 466. The flow housing 466 is coupled to the spring housing 432 and includes a setting port 468.

The setting collet 464 has an external profile 470 which interfaces with a packer shifting profile on the packer, as described above, during the setting to enable the second activation of setting assembly 400. The setting collet 464 is coupled to an upper shear sub 472 that is coupled to upper mandrel 406 through a shear device 474 (e.g., shear screws). The upper mandrel 406 includes a mechanism, such as a ratchet mechanism, which allows motion in only one direction. The ratchet mechanism may include a ratchet profile 476 formed in the outer surface of the upper mandrel 406 that interfaces with a ratchet ring 478 positioned within a ratchet housing 480 to allow motion in only one direction.

An upper seal sub 482 is coupled to the upper mandrel 406 and includes a seal assembly. The seal assembly may include two seals 442 that are spaced out via a spacer 444. In other embodiments, one, three, or more seals may be used in place of the seals 442 shown in FIG. 4. The upper seal sub 482 of the setting assembly may be coupled to one or more flow diverters. In one or more embodiments, each flow diverter includes a diverter sub 484 with multiple radial holes and a check valve 486 installed within each of the holes to allow the flow in only one direction. The check valves 486 are retained within the holes via retainers 488 and a sleeve 490. An upper cross over 492 may be coupled to a diverter sub 484 to allow the diverter sub 484 to connect to other tools in the tool string. In another embodiment, the flow diverter may include a sub with radial holes that each have a sealing ball seated in the radial holes and retained against the holes by a retainer to allow fluid to flow in only one direction.

Figure 5:
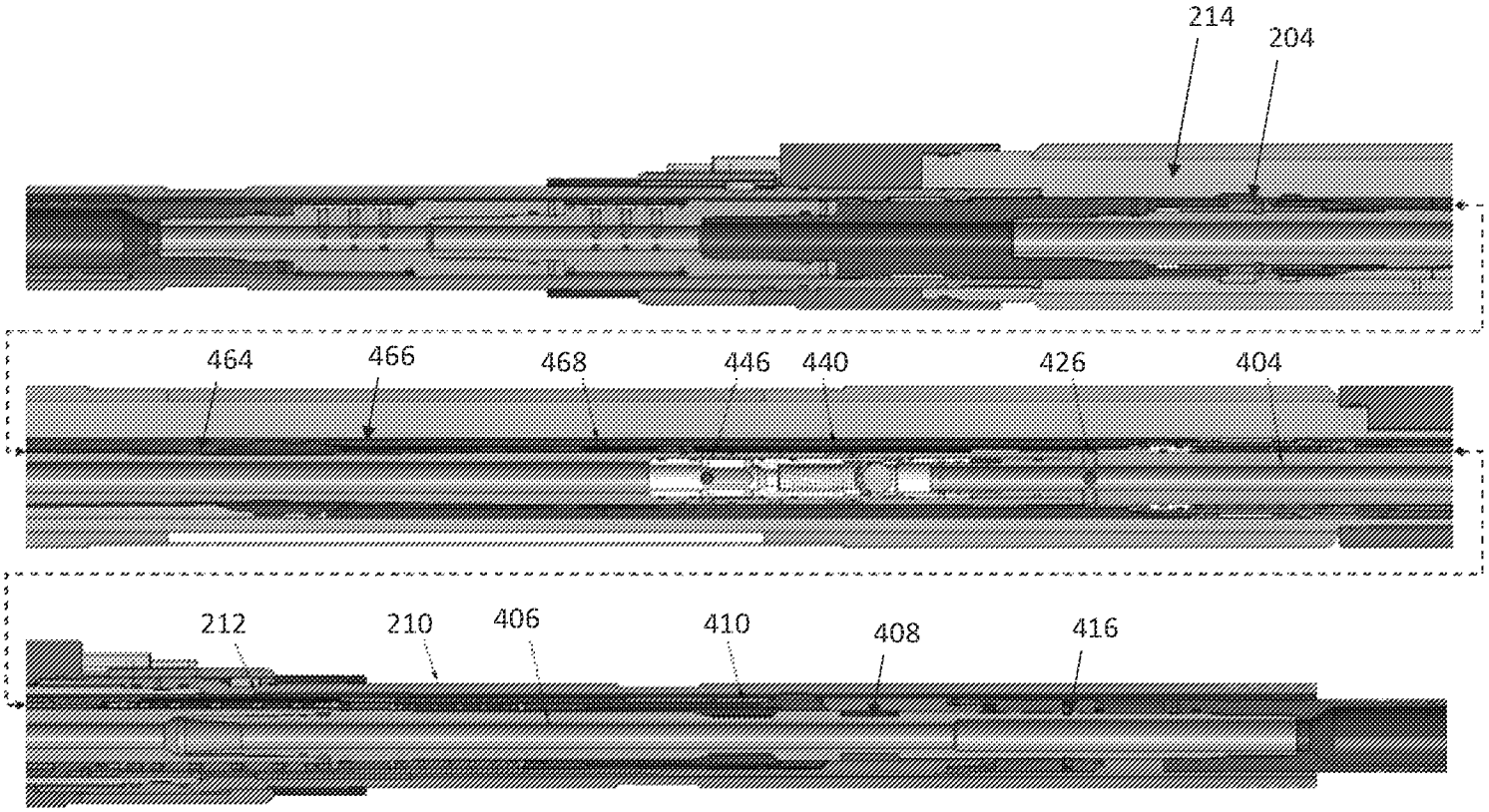
FIG. 5 is the packer assembly of FIG. 2 and the setting assembly of FIG. 4 in a run-in position for deployment within a wellbore.

Turning now to FIG. 5, FIG. 5 is the packer assembly 216 of FIG. 2 and the setting assembly 400 of FIG. 4 in a run-in position for deployment within a wellbore. In the run-in position, the setting assembly 400 is spaced out in string such that activation collet 410 is below the activation profile 212 in the lower packer mandrel 210. The run-in position allows the setting assembly 400 to perform wash down operations within the wellbore. During washdown, fluid is pumped through the bore of the setting assembly 400 and then flows to the wellbore through a pressure port 446 to the flow chamber 440, then through the washdown port 426 and bore of the middle and lower setting mandrels 404, 402. In the run-in position, the setting port 468 is isolated from the bore of the setting assembly 400.

When the packer assembly 216 has reached the desired location within the wellbore, the tool string is moved axially, causing the activation collet 410 to engage with activation profile 212 of the lower packer mandrel 210. Once engaged, further axial movement of the tool string and/or the setting mandrels 402, 404, 406 causes the shear device 416 to shear, enabling setting assembly to shift into an intermediate position where the activation collet 410 is positioned in the recess 408 and the setting collet 464 is disengaged from the flow housing 466. In the intermediate position, the pressure port 446 is in fluid communication with the washdown port 426, allowing the wellbore fluid displacement via the bore of the setting assembly 400. In addition, the setting port 468 is isolated from the bore of the setting assembly 400.

Figure 6:
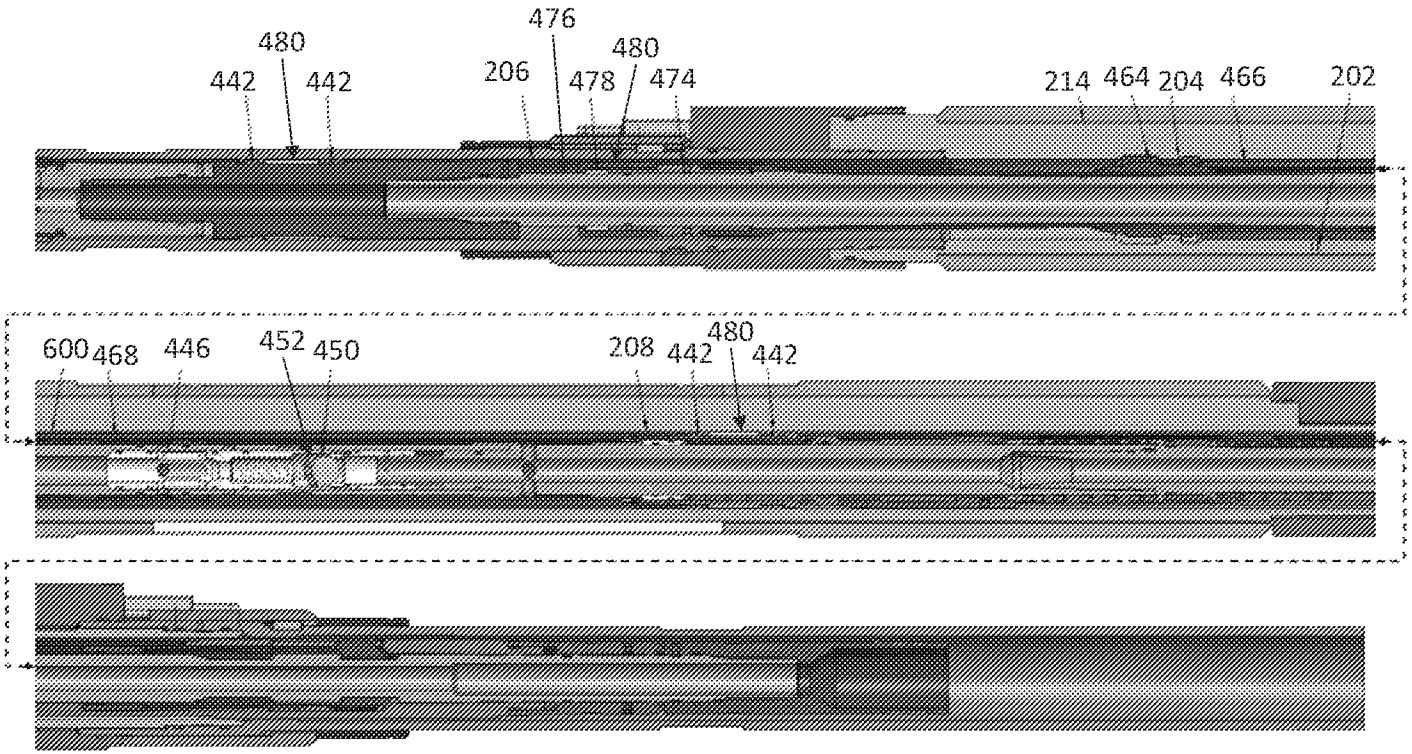
FIG. 6 is the packer assembly of FIG. 2 and the setting assembly of FIG. 4 in a second position.

To activate the setting assembly 400 a second time, the setting assembly 400 is moved downhole such that the setting collet 464 is positioned downhole of the shifting profile 204 within the upper packer mandrel 214. The tool string is then moved axially to cause the setting collet 464 to engage with the shifting profile 204 of the upper packer mandrel 214, as shown in FIG. 6. Further axial movement of the tool string causes the shear device 474 to shear, allowing the setting assembly 400 to shift into a setting position. Once the shear device is sheard, the setting collet 464 shifts into the flow housing 466, enabling fluid communication between pressure port 446 and the setting port 468. To ensure that the setting collet 464 will only move in the intended direction, the ratchet mechanism, including the ratchet profile 476 on the upper setting mandrel 406 engages with the ratchet ring 478 positioned within the ratchet housing 480.

Once the second activation completed, the setting assembly string is moved axially into the setting position that where a seal assembly, including two seals 442 that are spaced out via a spacer 444, on either side of the packer setting port 202 seals against the polished bores 206, 208 of the packer assembly 216, thus isolating the bore of the packer assembly 216. In the setting position, the setting port 468 on the setting assembly 400 is in fluid communication with the packer setting port 202. Hydraulic fluid or pressure can be applied from surface through the bore of the setting assembly 400 to set the packer assembly 216. The applied hydraulic pressure passes through the pressure port 446 to the annulus between packer and setting assembly 600, then into the expandable sleeve system via the setting port 202. The standing valve mechanism, including the ball 450 that is retained against the ball seat 452, restricts the flow of high-pressure fluid into the formation during setting of the packer assembly 216.

Figure 7:
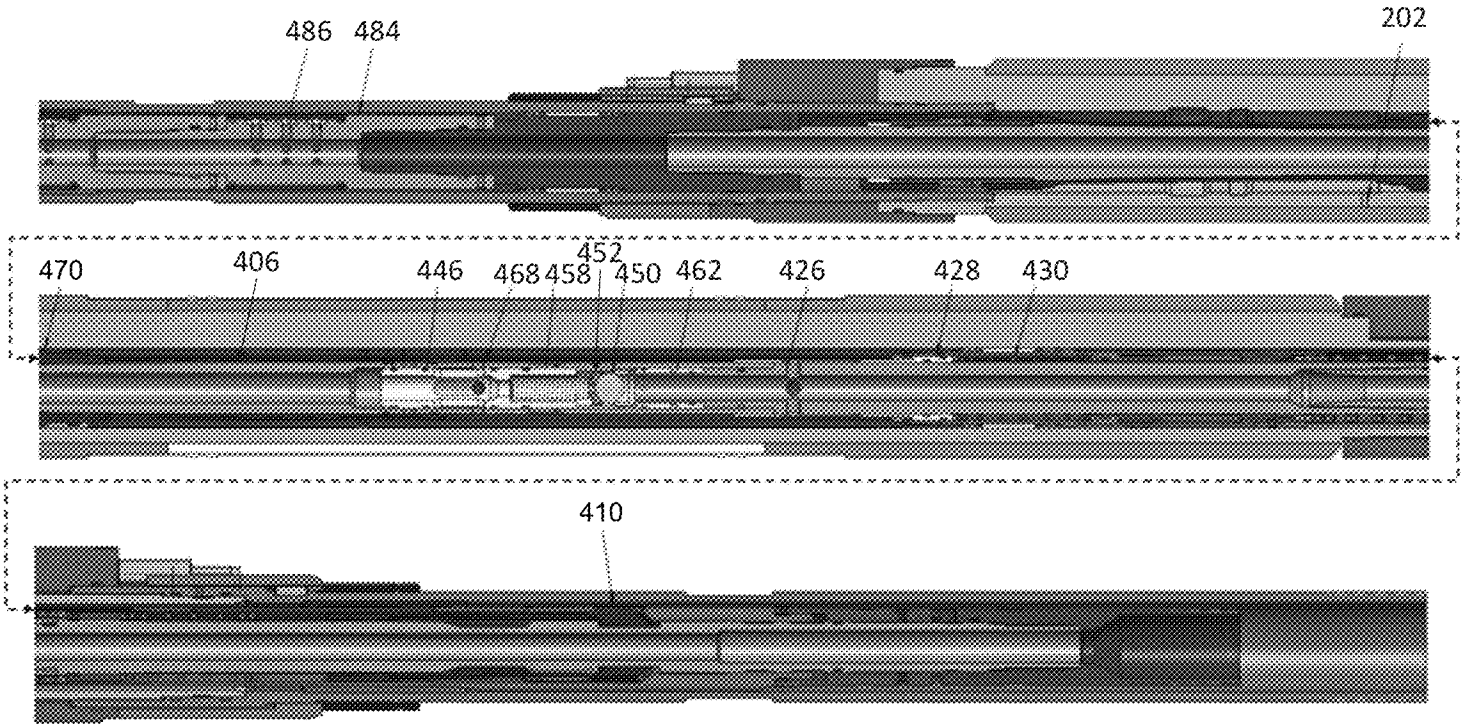
FIG. 7 is the packer assembly of FIG. 2 and the setting assembly of FIG. 4 in a third position.

Once the packer assembly 216 is set, the pressure within the setting assembly 400 is increased further to shear the shearing device 462. The spring cage 458 the shifts downhole within the upper setting mandrel 406, as shown in FIG. 7, closing the pressure port 446 and opening the deactivation port 448. In this configuration, the setting port 468 is closed and flow to wellbore is re-established through the deactivation port 448 and washdown port 426.

After the deactivation port 448 is opened, any pressure surge will create a high piston load on the shut-off mechanism, which includes the shut-off sleeve 428 and the spring 430. The spring 430 applies a force to the sleeve such that the washdown port 426 is open under no pressure differential. However, when there is a pressure surge, the pressure closes the washdown port 426. Closing the washdown port 426 allows the setting assembly to cut off any high pressure reaching to the formation and enable the operator to slowly bleed the pressure from surface. As soon as the pressure across the shut-off sleeve 428 is balanced, the spring 430 opens the washdown port 426 to re-establish the communication to the wellbore. Additionally, since both activation collet 410 and setting collet 464 are in retracted position, the tool string can be moved uphole or downhole for any further operation smoothly.

In one or more embodiments, the standing valve mechanism, including the ball 450 that is retained against the ball seat 452, opens to allow fluid from the annulus into the bore of the setting assembly 400 during gravel pack operations. In addition to or in place of the standing valve mechanism, the check valves 486 within the diverter sub 484 allow fluid from the annulus into the bore of the setting assembly 400.

Figure 8:
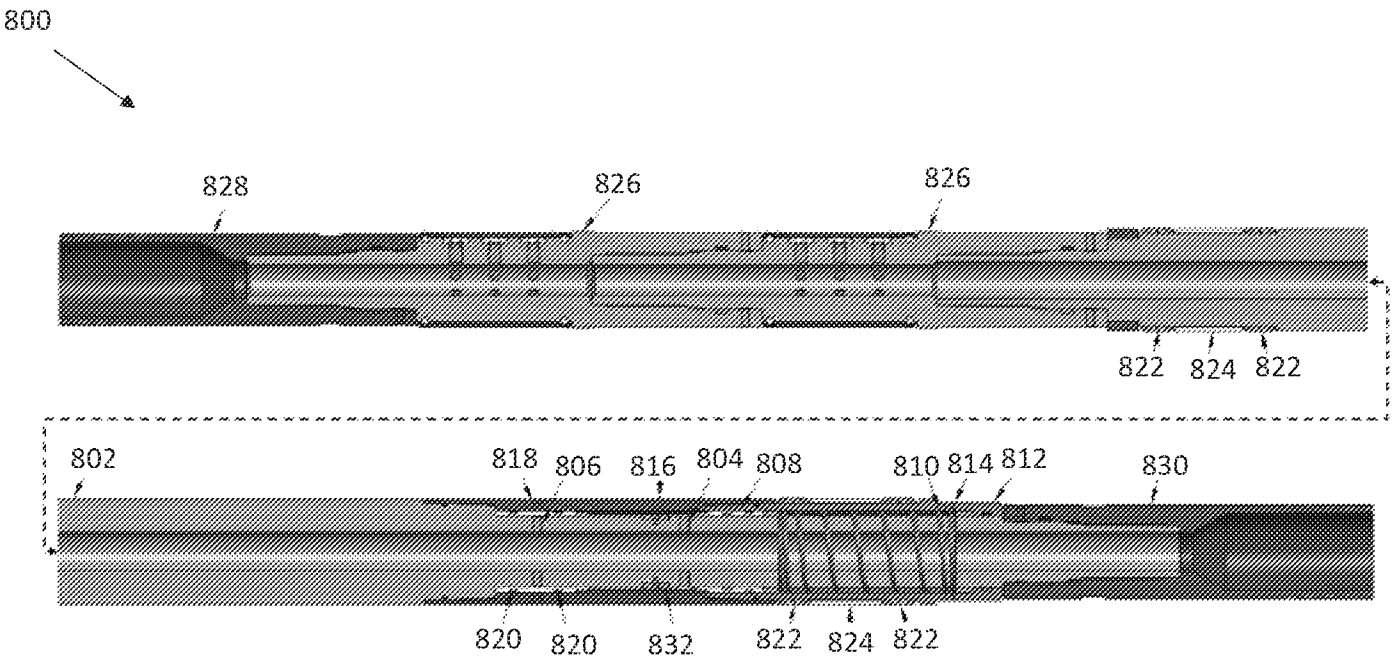
FIG. 8 is a setting patch for use within a wellbore.

Turning now to FIG. 8, FIG. 8 is a setting patch 800. The setting patch may be used with the setting assembly 400 described above to set additional packer assemblies 216 in a multiple zone system, as shown in FIG. 1. The setting patch is used to set packer assemblies 216 uphole of the setting assembly 400, which is used for packer assembly 216 that is furthest downhole. The setting patch 800 includes a setting patch mandrel 802 with an activation port 804 and a pressure port 806. A setting sleeve 808 is positioned around the setting patch mandrel 802 and is coupled to a spring 810 enclosed within a spring housing 812. The spring housing 812 includes a port 814 to balance the pressure within the spring housing 812 with formation hydrostatic pressure. A flow housing 816 is coupled to the setting patch mandrel 802 and includes radial port 818 that is isolated from the pressure port 806 via seals 820. The setting patch 800 also includes seal assemblies, which each may include two seals 822 that are spaced out via a spacer 824, seal against the polished bores 206, 208 of the packer assembly 216. The setting patch 800 may also include one or more flow diverters 826, as described above. The setting patch 800 may be coupled to the tool string via upper and lower crossovers 828, 830.

Once the setting assembly 400 and setting patches have been positioned within the wellbore, hydraulic pressure applied to set the packer assembly 216. The hydraulic pressure passes through the activation port 804 and applies a load to the spring 810. As applied hydraulic pressure increases, the setting sleeve 808 shifts to establish fluid communication between the pressure port 806 and the radial port 818. The hydraulic pressure will pass through the annulus between packer assembly 216 and setting patch 800, and to the expandable sleeve system through the setting port 202. Once the packer assembly 216 is set and hydraulic pressure is released, the spring 810 shifts the setting sleeve 808 to close the radial port 818. Additionally, in one or more embodiments, the setting patch 800 may include an anti-rotation system that includes a key 832 to guide the setting sleeve 808.

Using setting patches, multiple packers can be set simultaneously using only one setting assembly, thereby reduces operation time and the cost. In other embodiments, the packers separately using the same setting assembly multiple times.

As used herein, a range that includes the term between is intended to include the upper and lower limits of the range; e.g., between 50 and 150 includes both 50 and 150. Additionally, the term "approximately" includes all values within 5% of the target value; e.g., approximately 100 includes all values from 95 to 105, including 95 and 105. Further, approximately between includes all values within 5% of the target value for both the upper and lower limits; e.g., approximately between 50 and 150 includes all values from 47.5 to 157.5, including 47.5 and 157.5.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A packer system for use within a wellbore, the packer system comprising:
- a first packer assembly comprising;
  - a packer mandrel comprising:
    - a shifting profile formed on an inner surface of the packer mandrel;
    - an activation profile formed on the inner surface of the packer mandrel; and
    - a packer setting port extending radially through the packer mandrel; and
  - an expandable packer surrounding the packer mandrel proximate the packer setting port such that fluid flowing through the packer setting will expand the expandable packer; and
- a setting assembly positionable at least partially within a bore of the packer mandrel and comprising:
  - a setting mandrel;
  - an activation collet positioned about the setting mandrel and engageable with the activation profile to shear a first shear device and enable the setting assembly to move from a run-in position to an intermediate position; and
  - a setting collet positioned about the setting mandrel and engageable with the shifting profile to shear a second shear device and enable the setting assembly to move from the intermediate position to a setting position where fluid within a bore of the setting mandrel can flow through the setting port to expand the expandable packer.

2. The packer system of claim 1, wherein:
- the setting mandrel comprises an upper mandrel, a middle mandrel, and a lower mandrel;
- the activation collet is positioned about the lower mandrel; and
- the setting collet is positioned about the upper mandrel.

3. The packer system of claim 1, wherein:
- the packer mandrel comprises an upper packer mandrel and a lower packer mandrel;
- the upper packer mandrel comprises the shifting profile and the setting port; and
- the lower packer mandrel comprises the activation profile.

4. The packer system of claim 1, wherein the packer mandrel further comprises a bypass flow path extending axially through the packer mandrel.

5. The packer system of claim 1, wherein the expandable packer is a metallic expandable packer.

6. The packer system of claim 1, further comprising a flow diverter coupled to the setting mandrel.

7. The packer system of claim 1, wherein the setting mandrel further comprises a washdown port.

8. A completion system for use within a wellbore, the completion system comprising:
- a first packer assembly positionable within a wellbore and comprising;
  - a packer mandrel comprising:
  - a shifting profile formed on an inner surface of the packer mandrel;
  - an activation profile formed on the inner surface of the packer mandrel; and
  - a packer setting port extending radially through the packer mandrel; and an expandable packer surrounding the packer mandrel proximate the packer setting port such that fluid flowing through the packer setting will expand the expandable packer;

a tool string positionable within the wellbore; and a setting assembly coupled to the tool string and positionable at least partially within a bore of the packer mandrel and comprising:

a setting mandrel;

an activation collet positioned about the setting mandrel and engageable with the activation profile to shear a first shear device and enable the setting assembly to move from a run-in position to an intermediate position; and a setting collet positioned about the setting mandrel and engageable with the shifting profile to shear a second shear device and enable the setting assembly to move from the intermediate position to a setting position where fluid within a bore of the setting mandrel can flow through the setting port to expand the expandable packer.

9. The completion system of claim 8, wherein:

the setting mandrel comprises an upper mandrel, a middle mandrel, and a lower mandrel;

the activation collet is positioned about the lower mandrel; and the setting collet is positioned about the upper mandrel.

10. The completion system of claim 8, wherein:

the packer mandrel comprises an upper packer mandrel and a lower packer mandrel;

the upper packer mandrel comprises the shifting profile and the setting port; and the lower packer mandrel comprises the activation profile.

11. The completion system of claim 8, wherein the packer mandrel further comprises a bypass flow path extending axially through the packer mandrel.

12. The completion system of claim 8, wherein the expandable packer is a metallic expandable packer.

13. The completion system of claim 8, further comprising a flow diverter coupled to the setting mandrel.

14. The completion system of claim 8, wherein the setting mandrel further comprises a washdown port.

15. The completion system of claim 8, further comprising a second packer assembly positionable within the wellbore and, when positioned within the wellbore, uphole of the first packer assembly.

16. The completion system of claim 15, further comprising a setting patch coupled to the tool string uphole of the setting assembly and positionable at least partially within a bore of the second packer assembly.

17. The completion system of claim 16, wherein the setting patch comprises a setting sleeve shiftable to expand an expandable packer of the second packer assembly.

18. A method of completing a wellbore, the method comprising:

positioning a first packer assembly within a wellbore;

running a tool string comprising a setting assembly in a run-in position into the wellbore such that the setting assembly is positioned at least partially within a bore of a packer mandrel of the first packer assembly;

shifting an activation collet to shear a first shear device and shift the setting assembly from the run-in position to an intermediate position;

shifting a setting collet to shift the setting assembly to shift the setting assembly from the intermediate position to a setting position; and flowing fluid within a bore of a setting mandrel of the setting assembly through a setting port of the setting assembly to expand an expandable packer of the first packer assembly.

19. The method of claim 18, further comprising positioning a second packer assembly within the wellbore uphole of the first packer assembly.

20. The method of claim 19, further comprising expanding the second packer assembly via a setting patch coupled to the tool string and positioned uphole of the setting assembly.

* * * * *